US005390880A

United States Patent [19]

Fukawa et al.

[11] Patent Number: 5,390,880

[45] Date of Patent: Feb. 21, 1995

[54] TRAIN TRAFFIC CONTROL SYSTEM WITH DIAGRAM PREPARATION

[75] Inventors: Tatsuya Fukawa; Kenji Morihara, both of Amagasaki, Japan

[73] Assignee: Mitsubishi Denki Kabushiki Kaisha, Tokyo, Japan

[21] Appl. No.: 79,754

[22] Filed: Jun. 22, 1993

[30] Foreign Application Priority Data

Jun. 23, 1992 [JP] Japan ..... 4-164814

[51] Int. Cl.[6] ..... B61L 3/00

[52] U.S. Cl. ..... 246/167 R; 246/3; 104/88 R; 364/424.02

[58] Field of Search ..... 246/3, 4, 167 R, 176, 246/193; 104/88; 364/424.02

[56] References Cited

U.S. PATENT DOCUMENTS 4,179,739 12/1979 Virnot ..... 246/3 X
5,080,019 1/1992 Takemura et al. ..... 104/88

FOREIGN PATENT DOCUMENTS 226472 9/1989 Japan ..... 246/3
275264 11/1989 Japan ..... 246/3
3143769 6/1991 Japan ..... 246/3
4118358 4/1992 Japan ..... 246/3

*Primary Examiner*—Robert J. Oberleitner
*Assistant Examiner*—S. Joseph Morano
*Attorney, Agent, or Firm*—Oblon, Spivak, McClelland, Maier & Neustadt

[57] ABSTRACT

A train traffic control system which automatically prepares a shuttle service diagram based on a partial simulation of each train, at each station, etc., executed only by setting such initial data of the shuttle service as current states of trains in operation and possibility of service extension to other line, that is, other company line, a branch line or the like, when the shuttle service is required in a limited train section due to railroad accident or the like during the traffic control by a normal diagram, and controls the train route according to the shuttle service diagram.

5 Claims, 18 Drawing Sheets

Ⓐ
Ⓑ
LAN
4
ST22
RECEIVE DIAGRAM
ST23
CONTROL ROUTE
ST25
TRANSMIT ON-TRACK CONDITIONS DATA
ST24
ON-TRACK CONDITIONS DATA OBTAINED FROM TRACK CIRCUIT
INTERLOCKING DEVICE
6
5 STATION CONTROL DEVICE
ST22
RECEIVE DIAGRAM
ST23
CONTROL ROUTE
ST25
TRANSMIT ON-TRACK CONDITIONS DATA
ST24
ON-TRACK CONDITIONS DATA OBTAINED FROM TRACK CIRCUIT
INTERLOCKING DEVICE
6

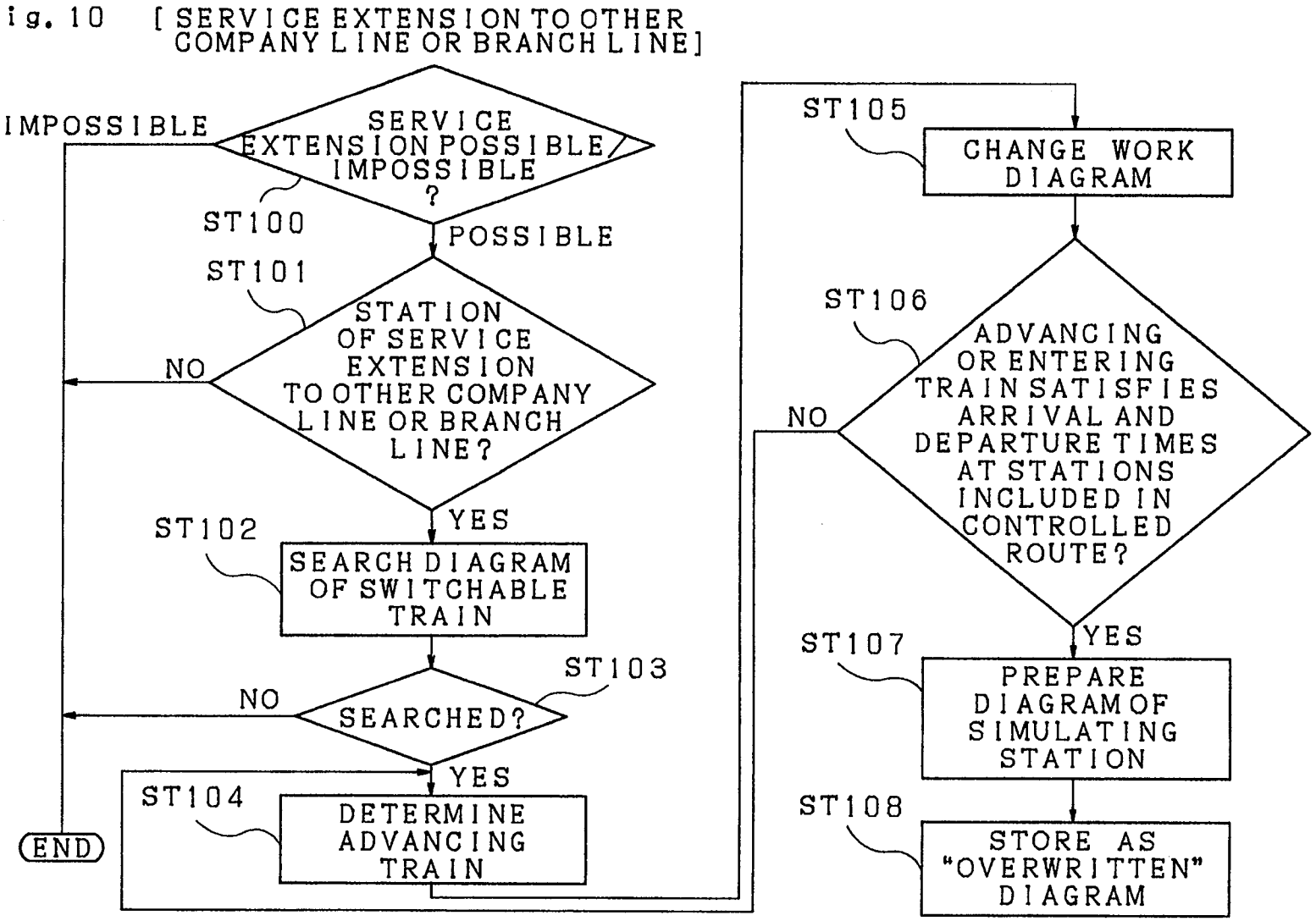
Fig. 10 [SERVICE EXTENSION TO OTHER COMPANY LINE OR BRANCH LINE]

TRAIN TRAFFIC CONTROL SYSTEM WITH DIAGRAM PREPARATION

BACKGROUND OF THE INVENTION

1. Field of the Invention

The present invention relates to a train traffic control system.

2. Description of the Related Art

FIG. 1 shows a structural diagram of a conventional train traffic control system. In the figure, the numerals designate the parts as follows: 1 a central processing unit for governing and controlling the entire system; 2 a display unit connected with the central processing unit 1 for displaying the day's diagram, train operating conditions and the like; 3 an input device provided adjacent to the display unit 2; 6 an interlocking device for controlling signals in operation, points and the like; 5 a station control device connected with the interlocking device 6 for controlling the same; and 4 a local area network (hereinafter referred to as LAN) serves as a transmission line between the station control device 5 and the central processing unit 1.

FIG. 2 shows an internal structural diagram of the devices constituting the train traffic control system shown in FIG. 1. In FIG. 2, numerals 11 through 18 represent the internal structure of the central processing unit 1, and numerals 51 through 54 the internal structure of the station control device 5, as follows, respectively: 11 a change data receiving part; 12 a diagram memory for storing the day's diagram or an updated diagram inputted beforehand; 13 diagram sectioning means for sectioning the day's diagram of each station; 14 diagram changing means for changing the day's diagram according to diagram change data received from the input device 3; 15 a diagram transmitting part for transmitting the sectioned diagram of each station and the day's diagram; 16 an on-track data receiving part for receiving on-track data transmitted from the station control devices 5; 17 on-track data arranging means for arranging the received on-track data for each train; 18 an on-track data transmitting part for transmitting the on-track data; 51 a diagram receiving part for receiving the day's diagram of the station transmitted from the central processing unit 1; 52 route controlling means for instructing a route control of trains according to the received the day's diagram to the interlocking device 6; 53 an on-track data receiving part for receiving the on-track data of the train obtained from the interlocking device 6; and 54 an on-track data transmitting part for periodically transmitting the received on-track data.

An operation will be described with referring to the internal structural diagram of FIG. 1 and an flowchart of information of the entire train traffic control system shown in FIGS. 3(*a*) and 3(*b*). A diagram information of trains operating on the day is inputted beforehand to the central processing unit 1, and saved in the diagram memory 12. The diagram sectioning means 13 sections the diagram information to station diagrams before the trains operate and prepares the day's diagram of each station (ST 11). The diagram transmitting part 15 transmits the day's diagram of each station through the LAN 4 to each station control device 5 (ST 12). The route controlling means 52 of each station control device 5 controls the route of the train which approaches the station to be controlled by the device according to the day's diagram received by the diagram receiving part 51 (ST 22) by controlling the signals, points or the like through the interlocking device 6. On the other hand, the day's diagram is transmitted to the display unit 2 via the diagram transmitting part 15 in response to a display instruction from an operator through 'the input device 3 (ST 13), and the day's diagram is displayed (ST 20).

The on-track data receiving part 53 of the station control device 5 receives on-track condition data including train data such as types and arrangement of trains obtained from the interlocking device 6, station data such as arrival and departure times and the like according to operation results (ST 24), and periodically transmits the data from the on-track data transmitting part 54 through the LAN 4 to the central processing unit 1 (ST 25). Accordingly, in the central processing unit 1, the on-track data receiving part 16 receives the on-track conditions data transmitted from the station control devices 5 (ST 15), the on-track data arranging means 17 arranges the train data and the station data for each train (ST 16), and the on-track data transmitting part 18 transmits the data to the display unit 2 (ST 17). The display unit 2 displays the operating conditions on the basis of the transmitted on-track data, according to a display instruction from the operator through the input device 3 (ST 21).

The display unit 2 is capable of graphically displaying a schematic drawing of the route controlled by the system and trains together with control numbers which are currently on the route, for example, and also capable of graphically displaying an actually operated diagram within a certain period by managing the operational conditions of the trains in relation to the arrival and departure times at each station. The displaying contents can be changed also through the input device 3. The operator can monitor train operational conditions via those man-machine interfaces.

When judging it is impossible to operate under the scheduled diagram owing to disorder in the train operation, the operator inputs diagram change data through the input device 3 to stabilize the train operation (ST 50). The diagram change data includes such items as: (a) sequential change of the train operation to change the sequence of the train departures in a train section between specified stations; (b) train operation switching to switch a specified train to another specified train at a specified station; (c) train type change to change a specified train to a specified type (special express, express, local, etc.) in a section between specified stations; (d) time change to advance or postpone the departure time of a specified train in a section between specified stations by a specified length of time; (e) suspension of service to suspend operation of a specified train at a specified station; (f) restoration to restore a specified train (suspended) into operation; (g) train setting to newly start operation of a train at a specified time in a section between specified stations; (h) track change to change a track number for a specified train to a specified track number at a selected station; (i) destination change to change the destination of a specified train.

The change data receiving part 11 of the central processing unit 1 receives the diagram change data including the diagram change items, specified train data, specified station data, and the like inputted through the input device 3 (ST 9) and transmits the data to the diagram changing means 14. The diagram changing means 14 updates the day's diagram saved in the diagram memory 12, stores the updated the day's diagram in the diagram memory 12 and transmits the updated the day's diagram to the diagram sectioning means 13 (ST 10). Simultaneously, the diagram changing means 14 transmits the updated day's diagram to the display unit 2 (ST 13) via the diagram transmitting part 15, and the display unit 2 displays the transmitted diagram in response to a display instruction from the operator (ST 20). The diagram sectioning means 13 sections the updated diagram to newly prepare the day's diagram of each station (ST 11), and transmits it from the diagram transmitting part 15 through the LAN 4 to the station control device 5 (ST 12). The diagram receiving part 51 of the station control device 5 receives the updated day's diagram (ST 22), and the route controlling means 52 controls train routes through the interlocking device 6 according to the received the day's diagram by controlling the signals and points relative to trains that approach the station to be controlled by the station control device (ST 23).

As a matter of fact, a railroad service in the suburbs of a large city plays an important role as a commuter transport means, so that a disorder in train operation seriously affects the society. When a critical disorder occurs in the train operation such as a train accident at a station or between stations far from any railway yard and it is impossible for the succeeding trains in operation to avoid the troubled train, a new diagram for the shuttle service (hereinafter referred to as a shuttle diagram) is required from the current on-track positions of trains in train sections which sandwich the section where the troubled train is, between stations having shuttling installations and both of the end stations. However, in the conventional traffic control system, the operator has to change the day's diagram for the shuttle service for every train by combining the predetermined diagram change items, so that, practically, the operator often controls the train routes manually after suspending the traffic control system of automatically controlling the train operation according to the diagram, by using a man-machine interface because of a lot of the diagram change items, of a long time required for processing to change the diagram and the like.

SUMMARY OF THE INVENTION

The present invention has been devised to solve the above problems, and has for its object to provide a traffic control system capable of lightening the burden for preparing a shuttle diagram which has been conventionally prepared by an operator, and capable of swiftly controlling a train route without discontinuing the control by the traffic control system even when a disorder in a diagram caused by a train accident or the like occur.

The above and further objects and features of the invention will more fully be apparent from the following detailed description with accompanying drawings.

BRIEF DESCRIPTION OF THE DRAWINGS

FIG. 3 (*b*) is a data processing flowchart of the entire conventional train traffic control system;

FIG. 5 (*b*) is an internal structural diagram of the train traffic control system according to the embodiment of the invention;

FIG. 6 (*b*) is a data processing flowchart of the entire train traffic control. system according to the embodiment of the invention;

FIG. 9 (*b*) is a detailed data processing flowchart of the step of a diagram preparation (ST 6) in FIG. 6;

FIG. 9 (*c*) is a detailed data processing flowchart of the step of a diagram preparation (ST 6) in FIG. 6;

FIG. 10 is a data processing flowchart of Embodiment 2 of the invention;

DESCRIPTION OF THE PREFERRED EMBODIMENTS

Embodiment 1

Figure 1:
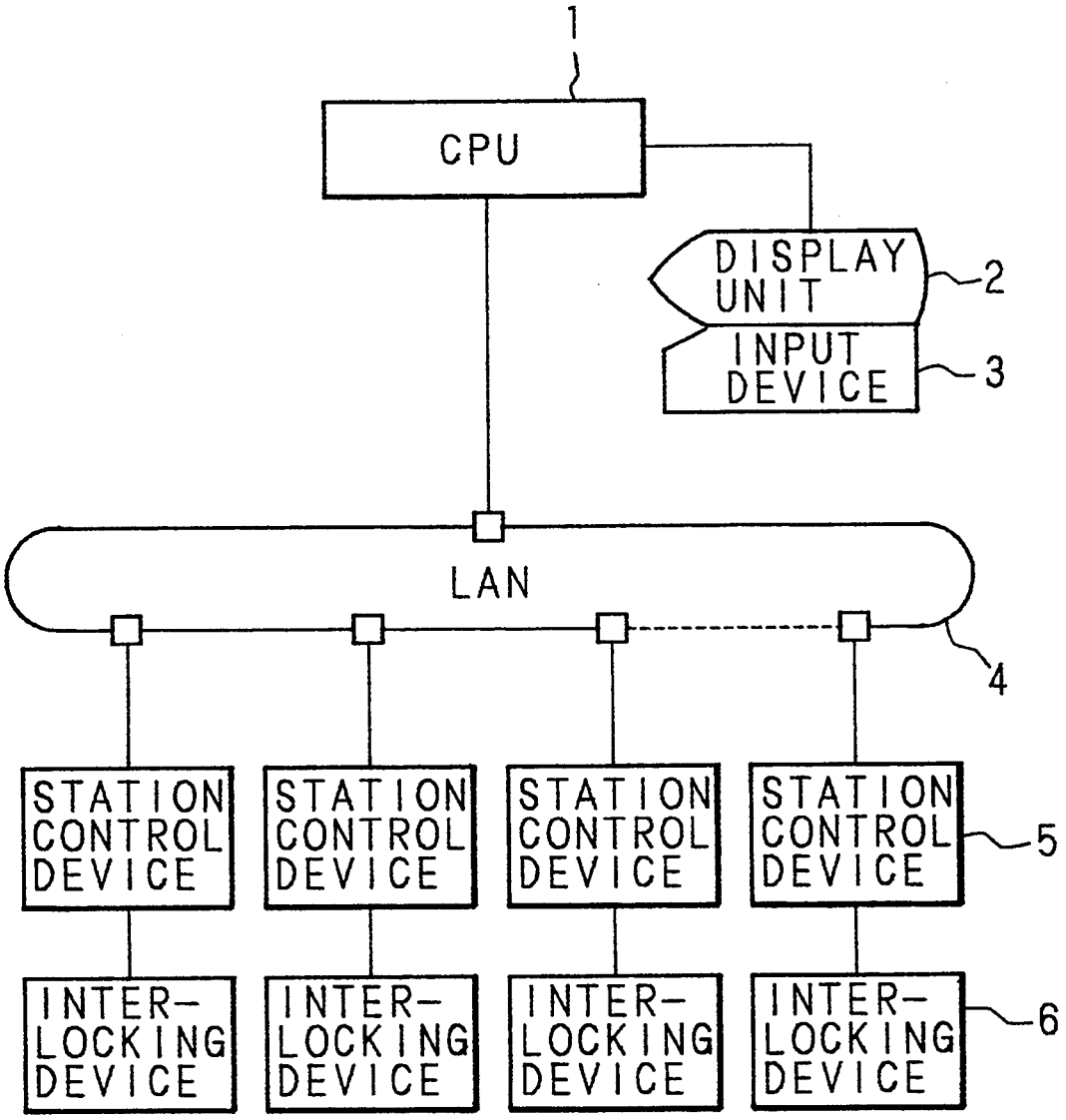
Fig. 1 Prior Art
FIG. 1 is a structural diagram of a conventional traffic control system.
Figure 2:
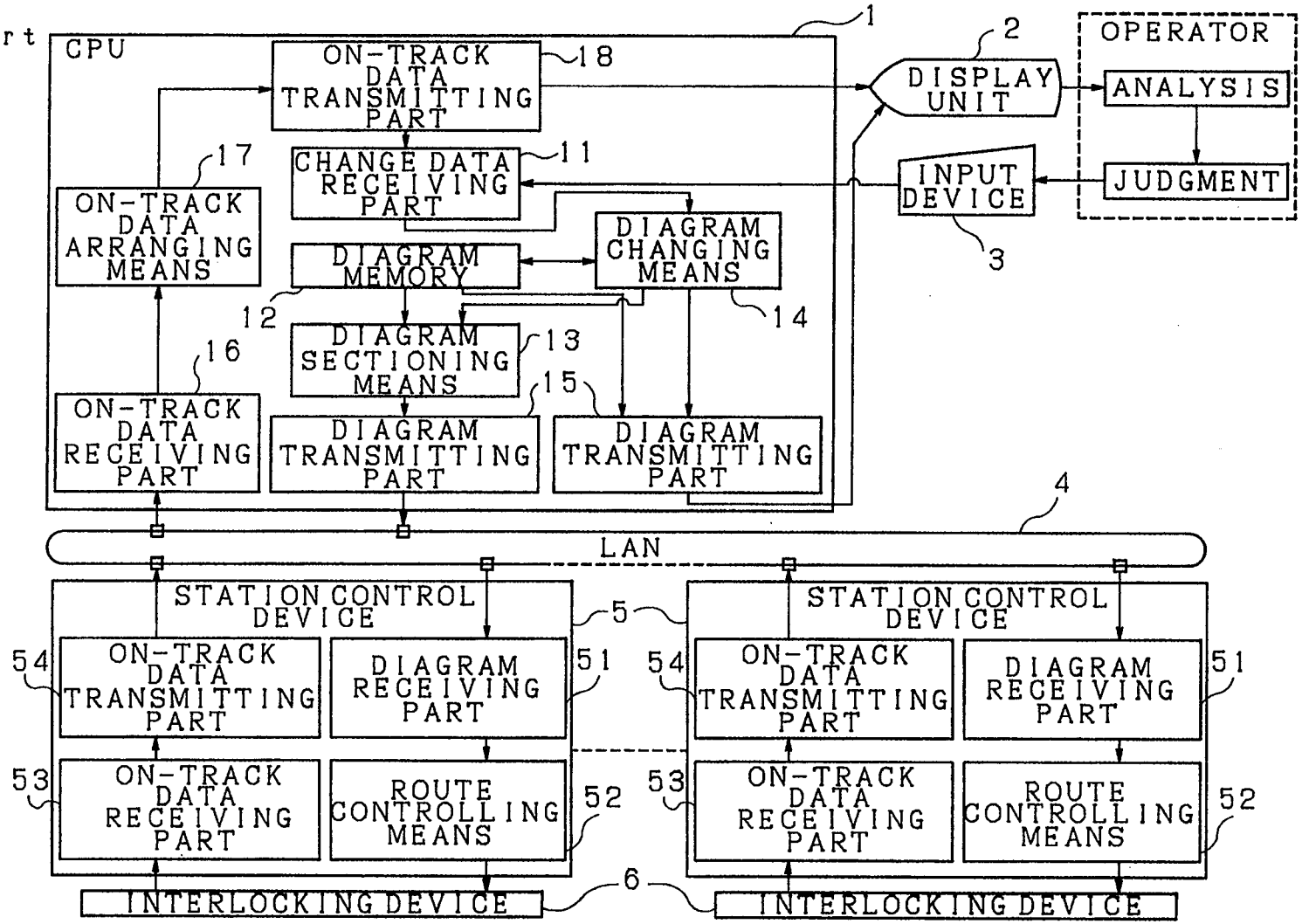
Fig. 2 Prior Art
FIG. 2 is an internal structural diagram of the conventional traffic control system.
Figure 3A:
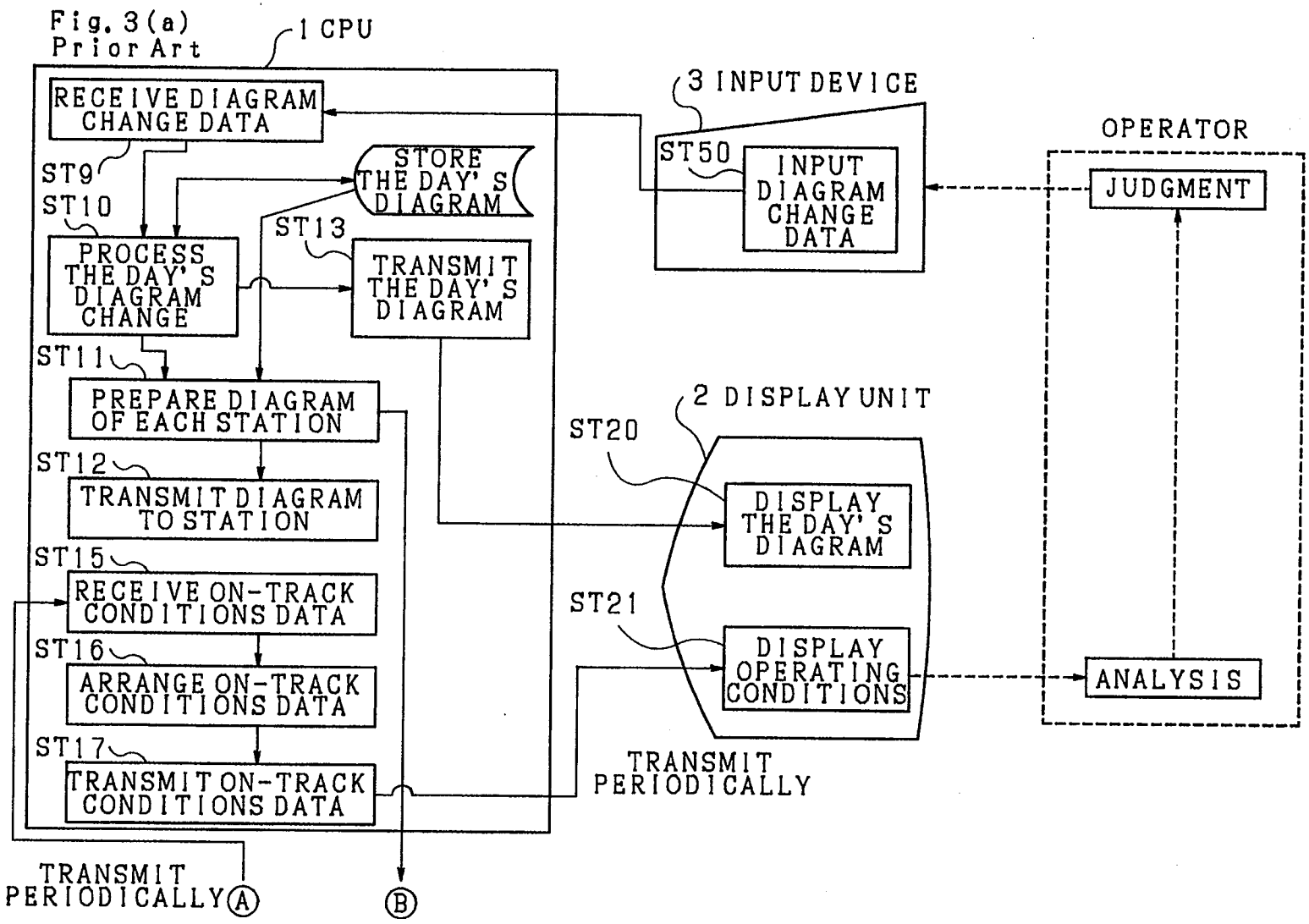
Fig. 3(a) Prior Art
FIG. 3 (*a*) is a dacha processing flowchart of the entire conventional train traffic control system.
Figure 3B:
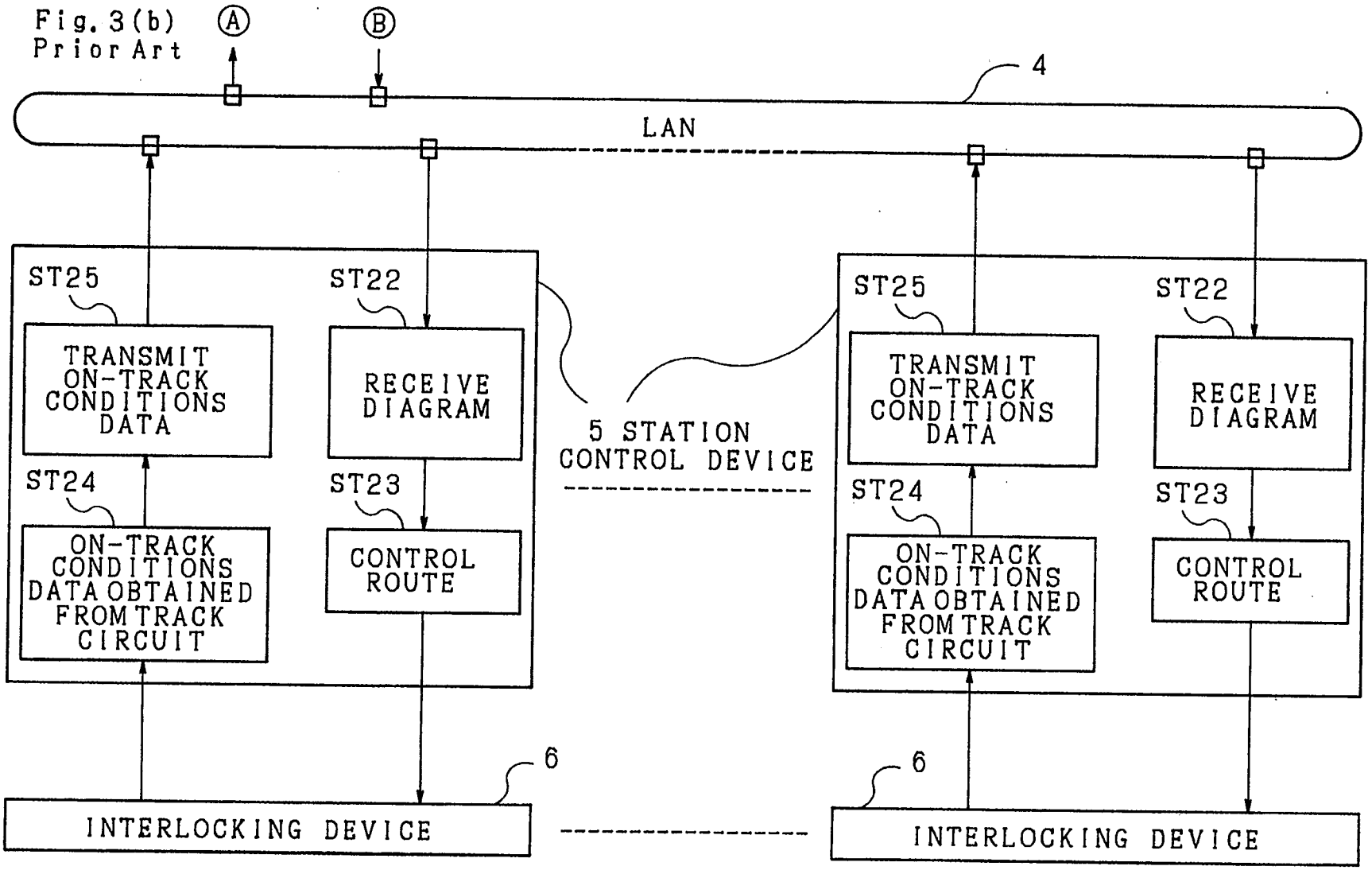
Fig. 3(b) Prior Art
Figure 4:
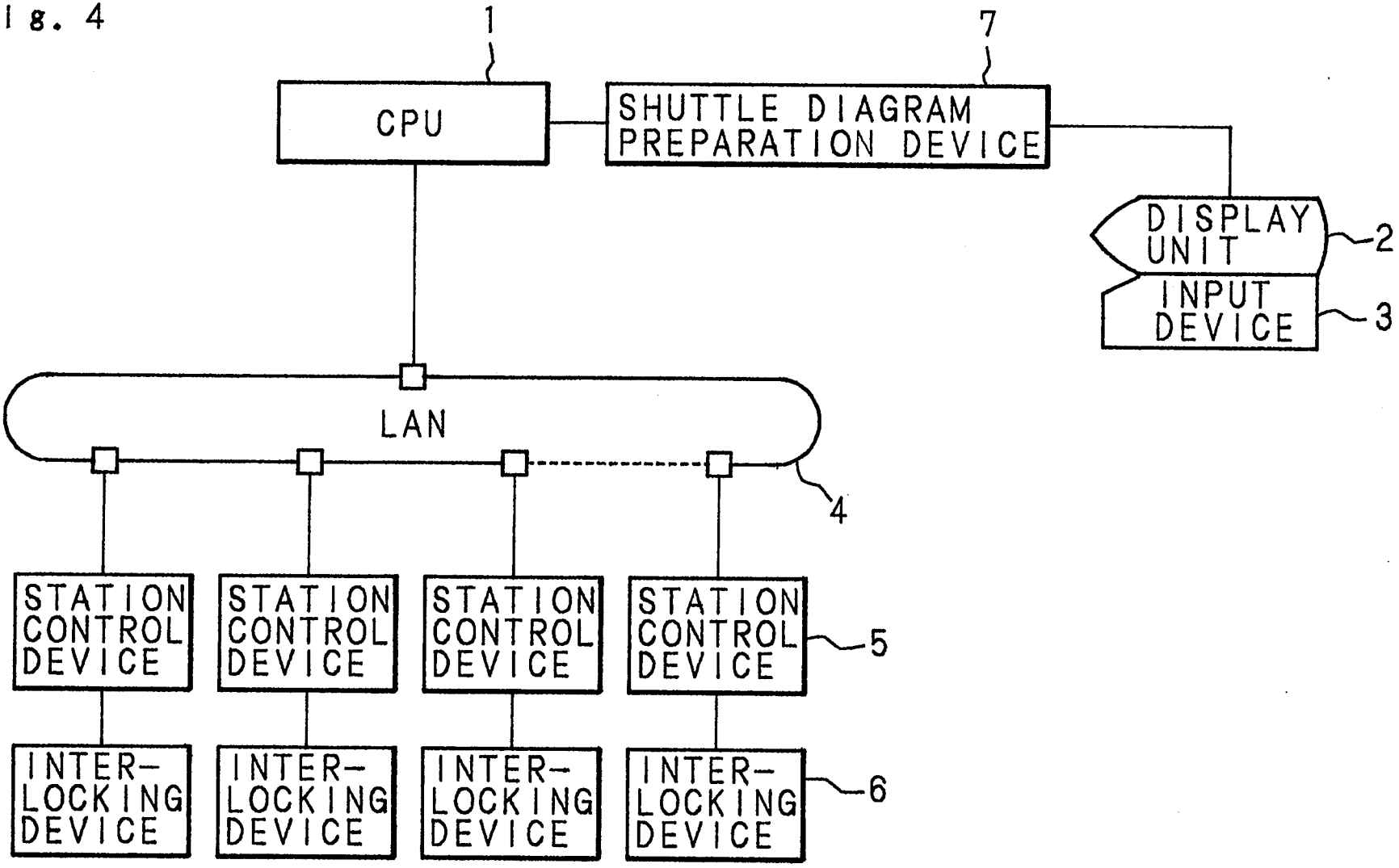
FIG. 4 is a structural diagram of a train traffic control system according to an embodiment of the invention.
Figure 5A:
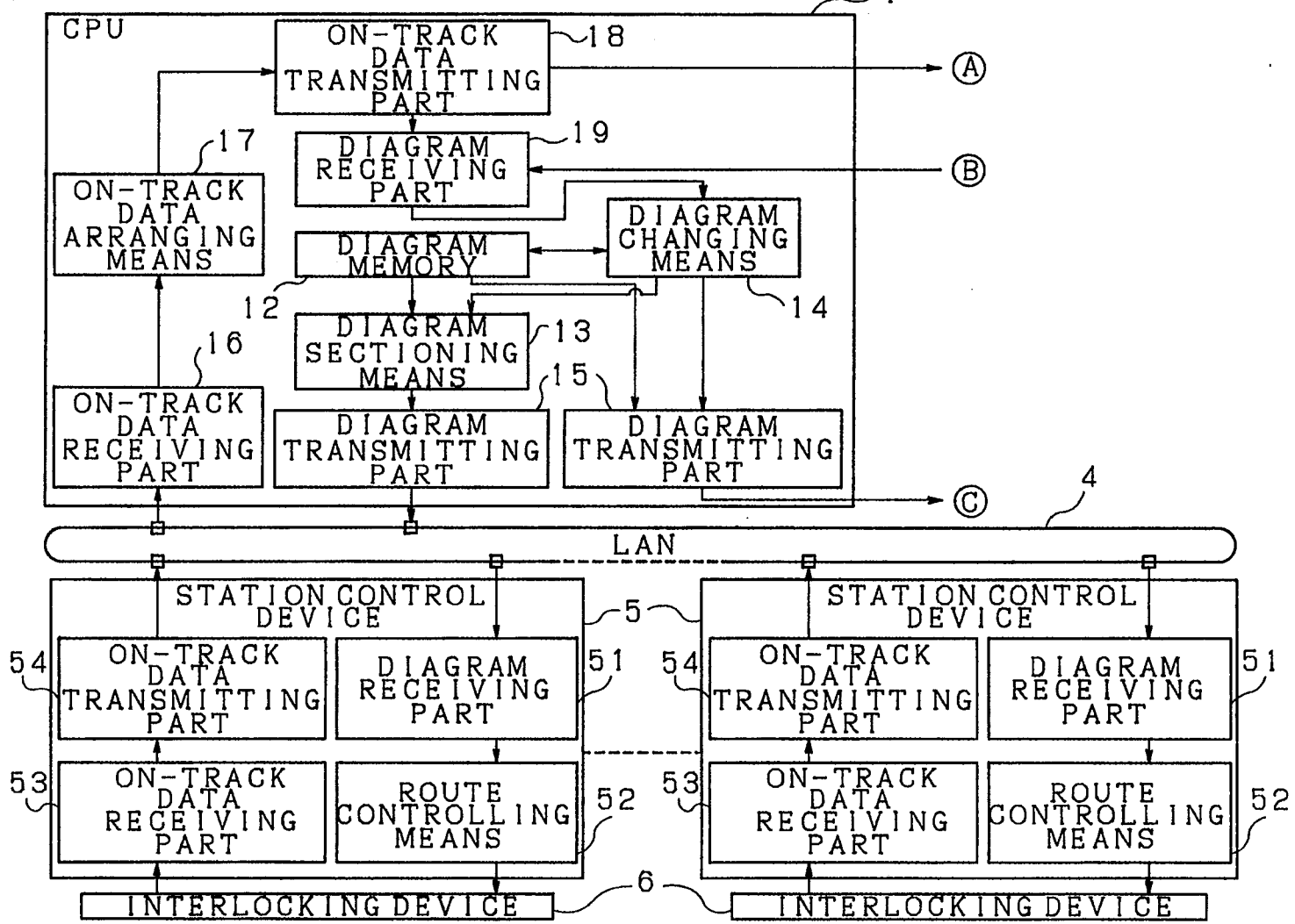
FIG. 5 (*a*) is an internal structural diagram of the train traffic control system according to the embodiment of the invention.
Figure 5B:
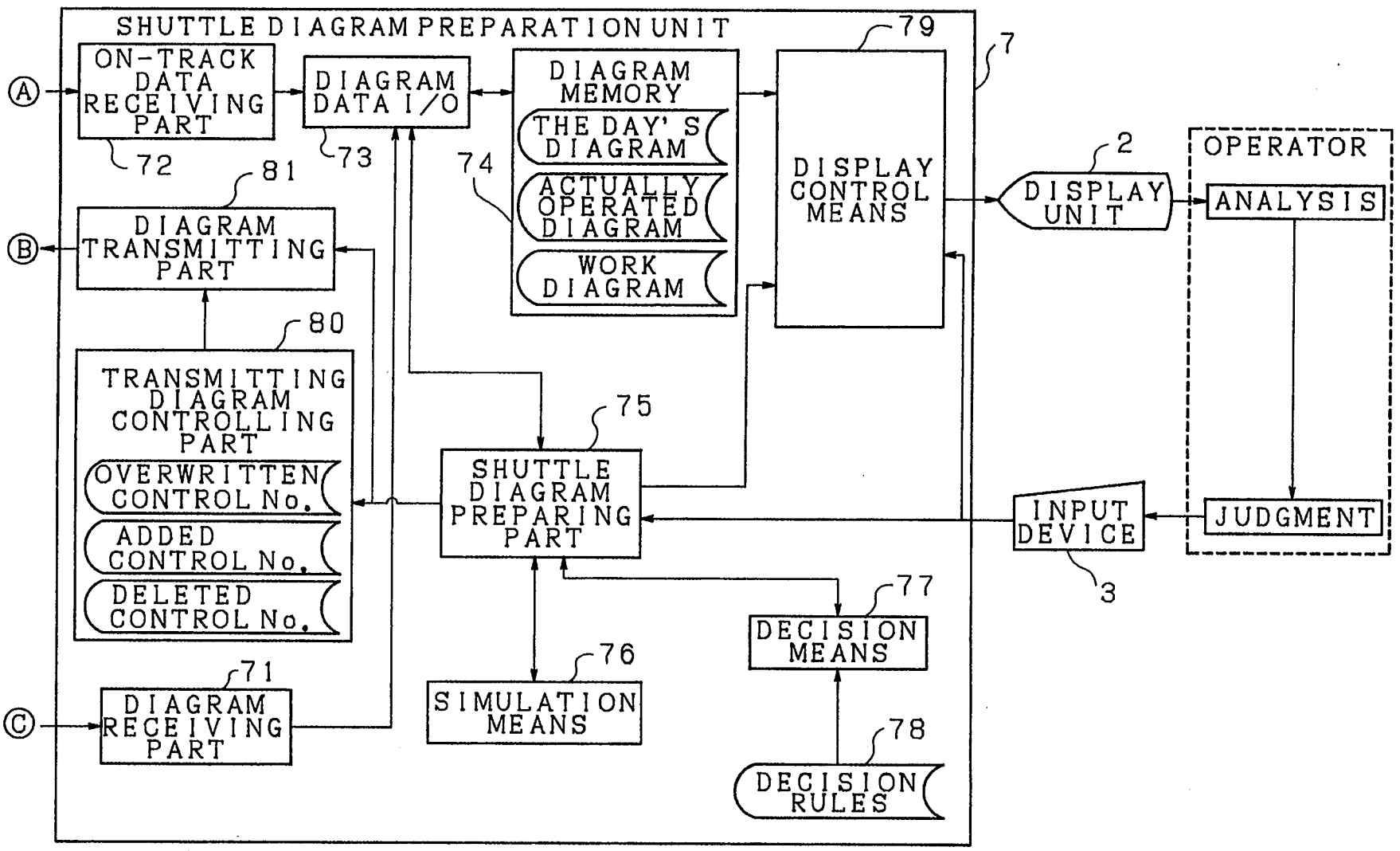

FIG. 4 is a structural diagram of a traffic control system showing an embodiment of the invention, and FIGS. 5 (*a*) and (*b*) are its internal structural diagrams. In the figures, numerals 1 through 6, 12 through 18 and 51 through 54 represent the same or equivalent parts to those of the conventional system. In the embodiment, numeral 7 designates a shuttle diagram preparation unit; 19 a diagram receiving part for receiving a shuttle diagram prepared by the shuttle diagram preparation unit; 71 a diagram receiving part for receiving the day's diagram transmitted from the central processing unit 1; 72 an on-track data receiving part for receiving on-track data transmitted from the central processing unit 1; 73 a diagram data I/O for inputting, outputting or rewriting data; 74 a diagram memory for storing updated data from the diagram data I/O 73; 75 a shuttle diagram preparing part for preparing a shuttle diagram; 79 a display control means for controlling display of the display unit 2; and 80 a transmitting diagram controlling part for storing and transmitting a prepared shuttle diagram to the central processing unit 1 by processing type such as overwriting, addition or deletion. In the embodiment, although the transmitting diagram controlling part 80 is placed in the shuttle diagram preparation unit 7, it may be placed in the central processing unit 1.

Figure 6A:
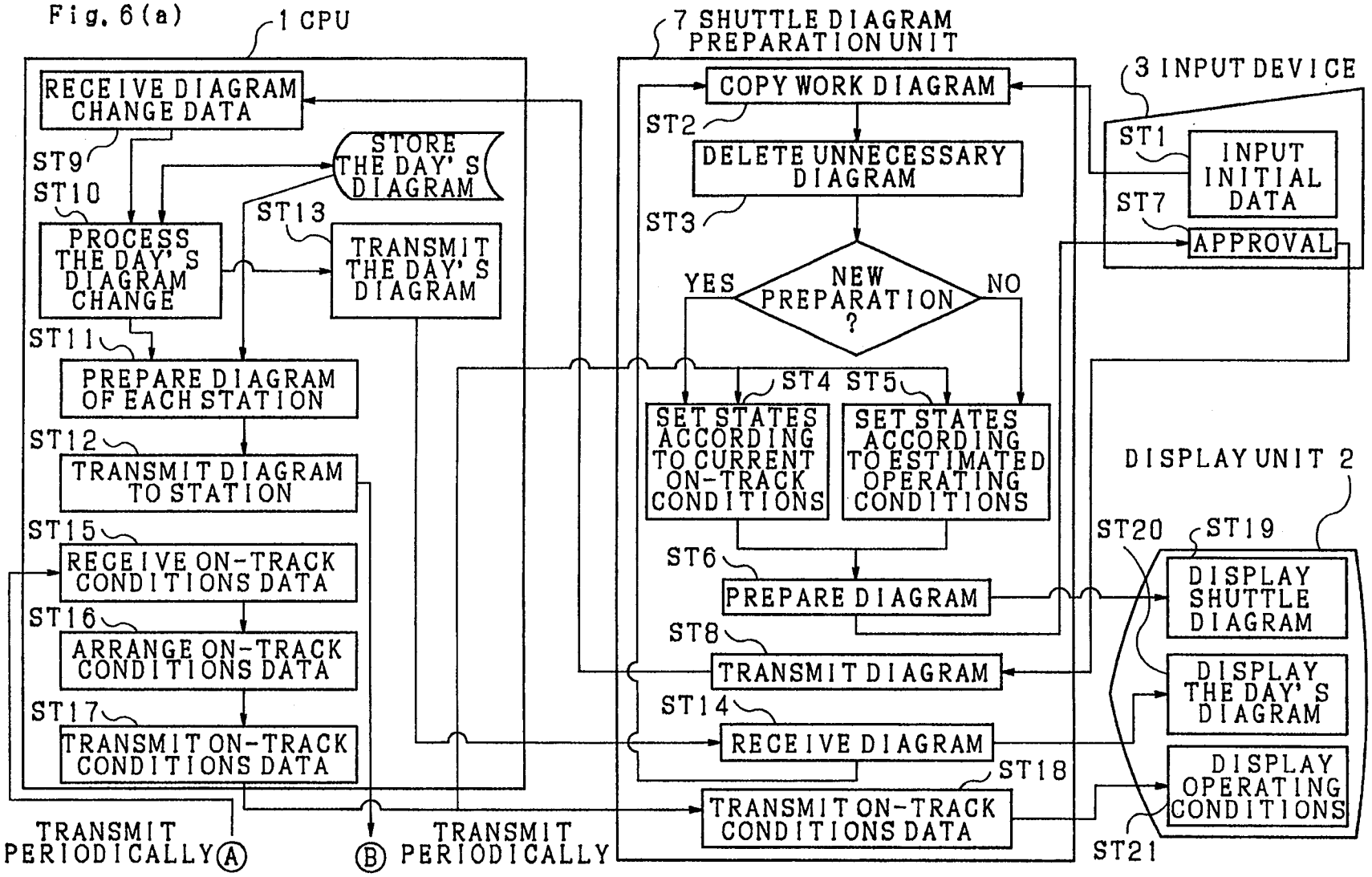
FIG. 6 (*a*) is a data processing flowchart of the entire train traffic control system according to the embodiment of the invention.
Figure 6B:
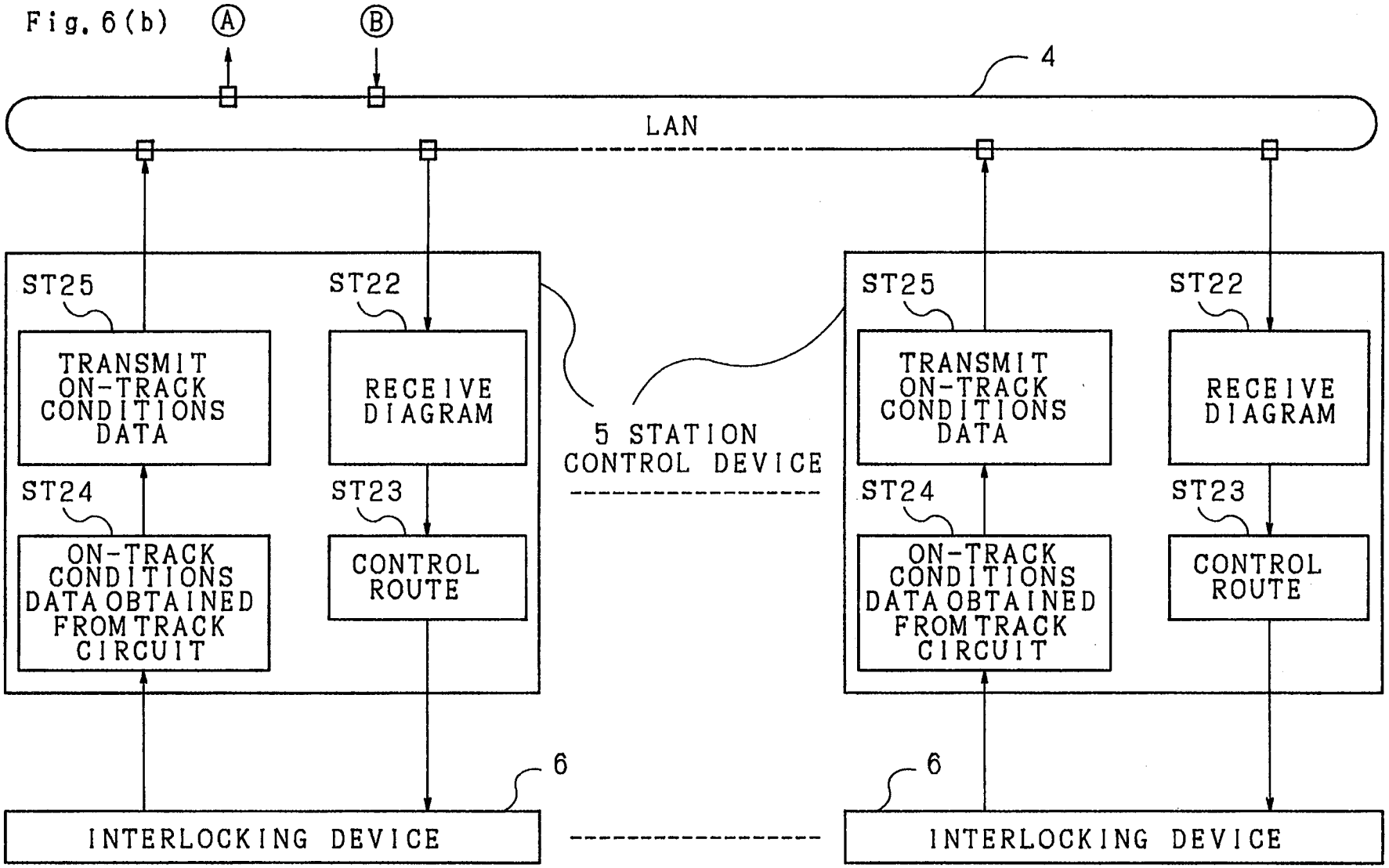
Figure 7:
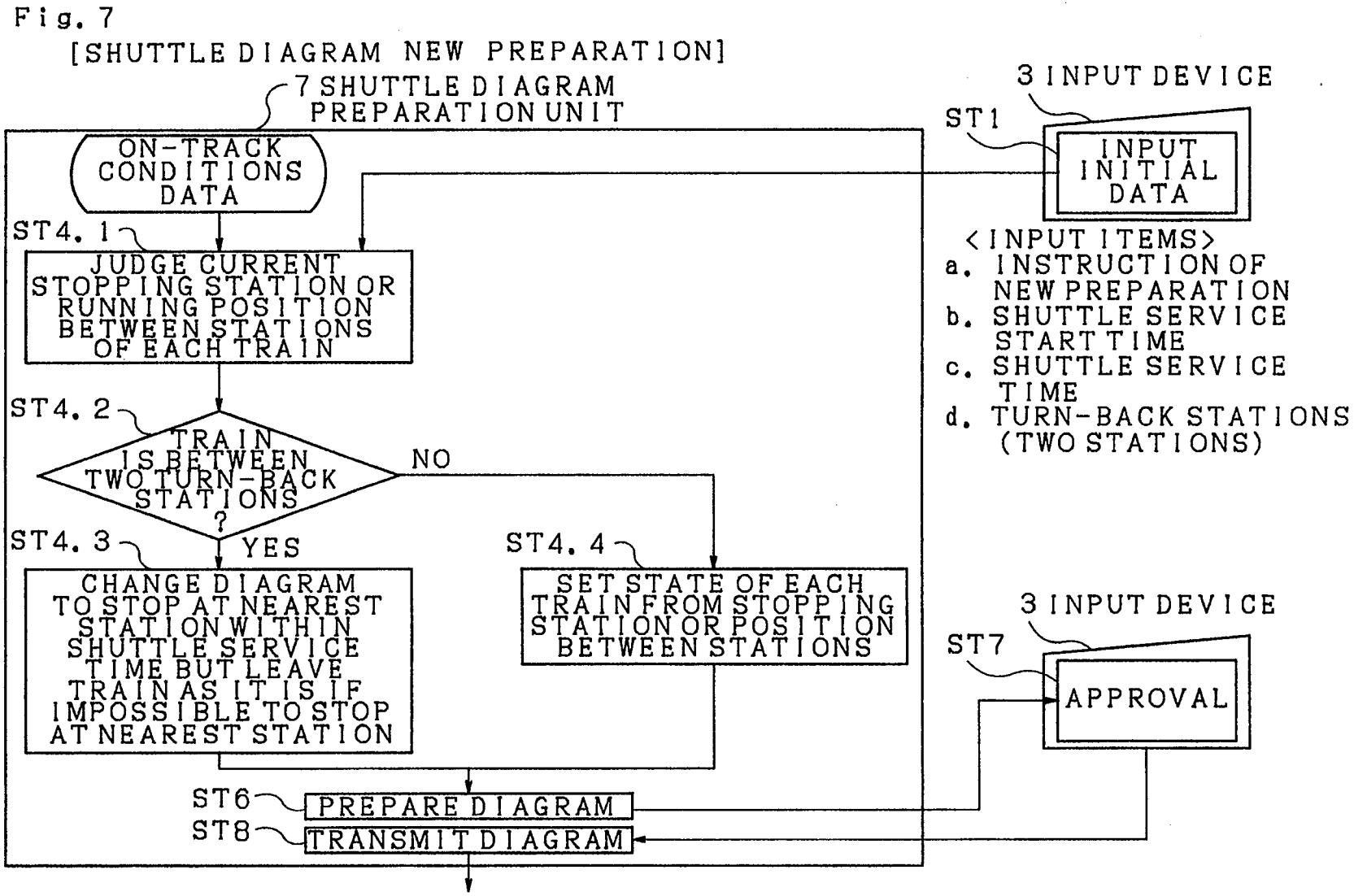
FIG. 7 is a detailed data processing flowchart of the step of a shuttle diagram new preparation (ST 4) in FIG. 6.
Figure 8:
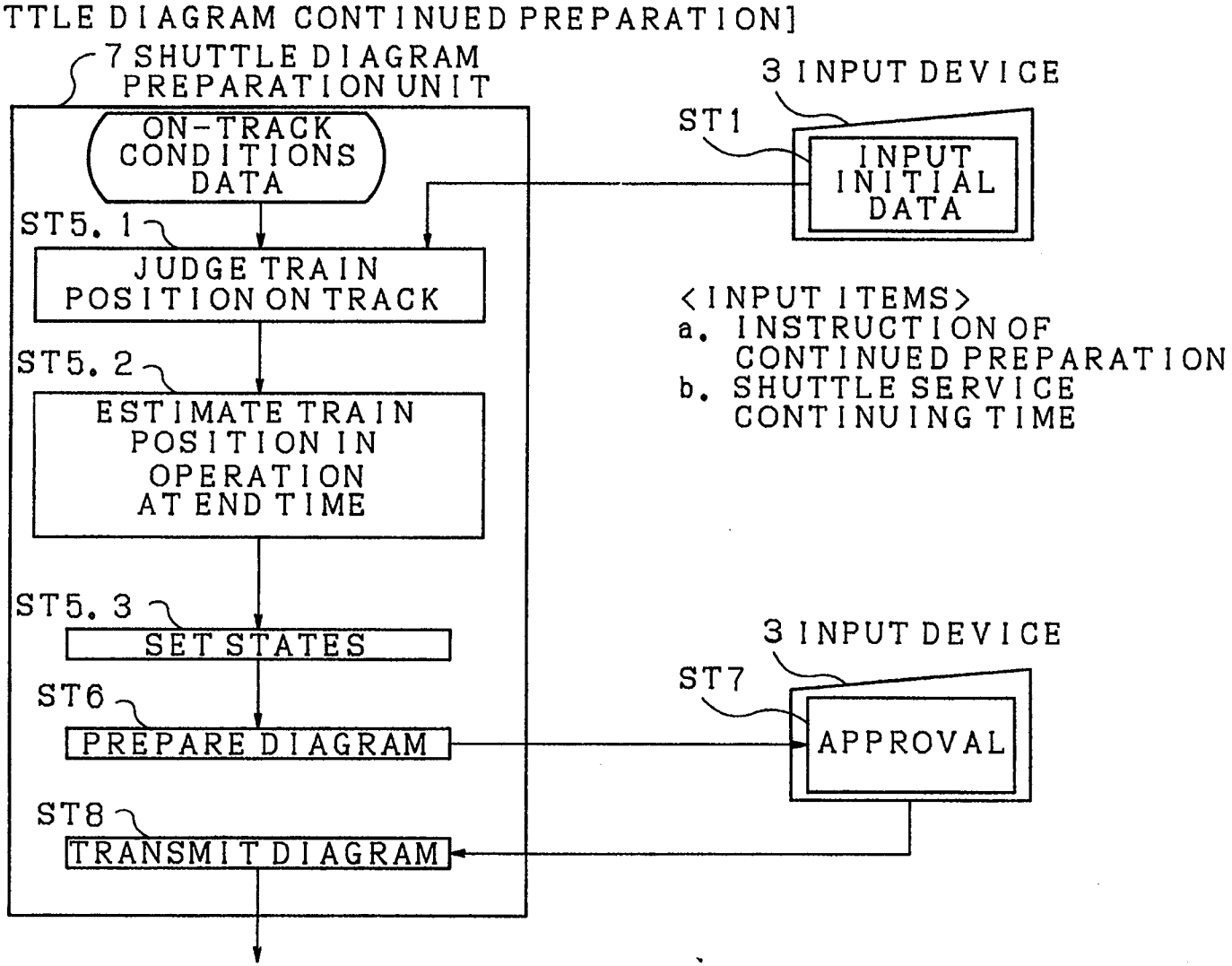
FIG. 8 is a detailed data processing flowchart of the step of a continued preparation of the shuttle diagram (ST 5) in FIG. 6.
Figure 11:
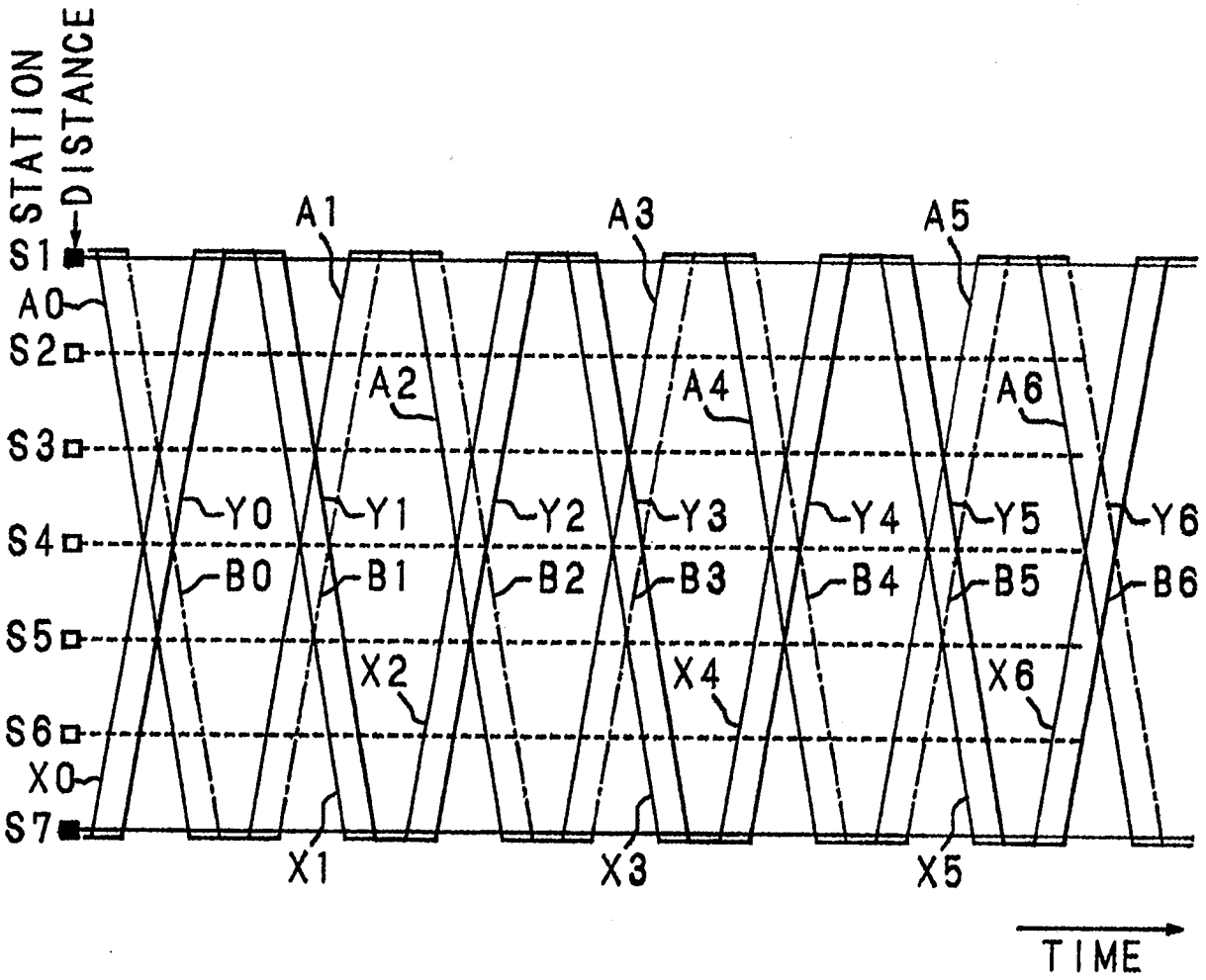
FIG. 11 is the day's diagram.
Figure 12:
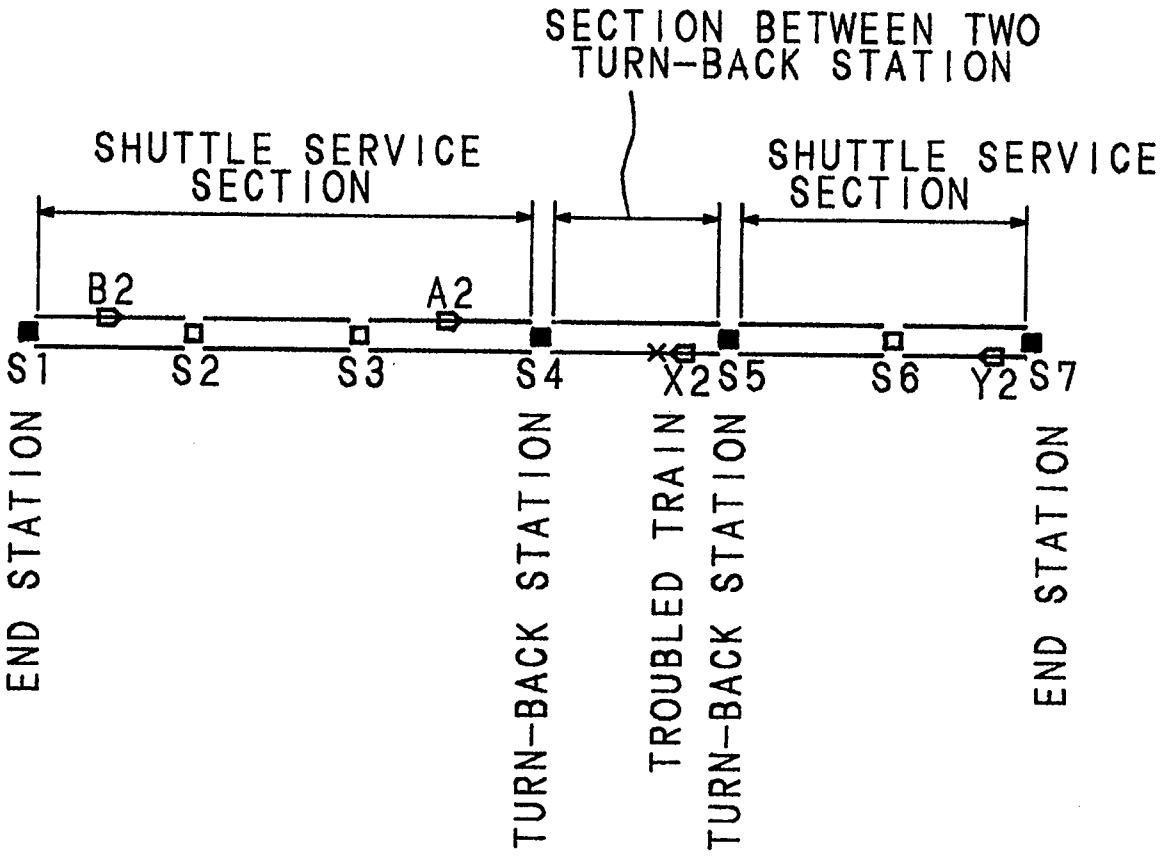
FIG. 12 is a traffic route chart of FIG. 11.
Figure 13:
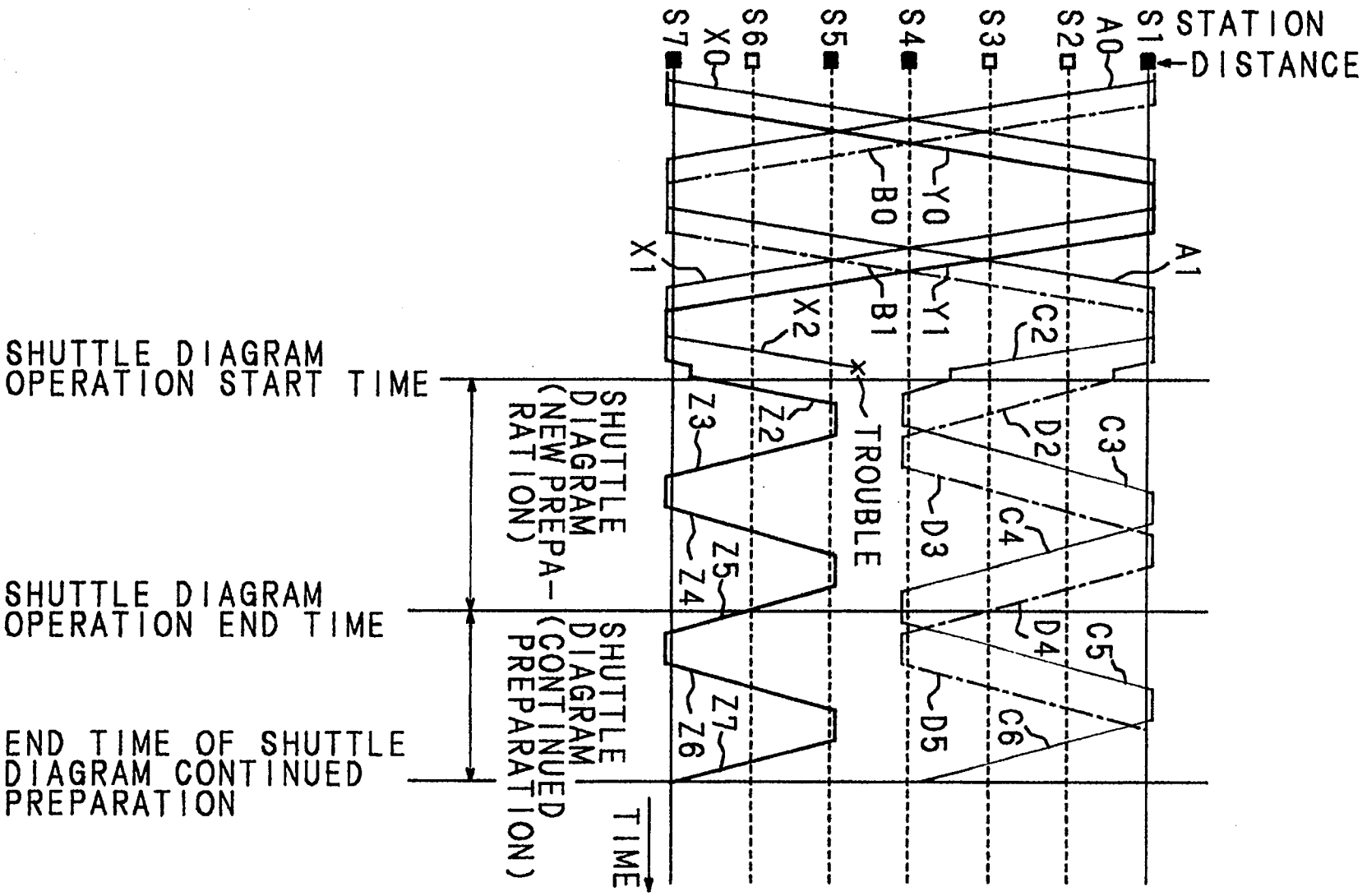
FIG. 13 is the updated day's diagram.

The operation of Embodiment 1 will be described hereinafter by referring to FIGS. 6 through 9 and FIGS. 11 through 13. Since normal train operation (without disorder) is identical with that of the conventional system, by the same operation is shown by the same numerals in FIGS. 4 and 5 as those of the conventional system, and description will be omitted here. FIGS. 6 (*a*) and (*b*) are a data processing flowchart of the entire system according to the invention, FIG. 7 is a detailed data processing flowchart of a step for a new preparation of a shuttle diagram new preparation (ST 4) in FIG. 6, FIG. 8 is a detailed data processing flowchart of a step for a continued preparation of a shuttle diagram (ST 5) in FIG. 6, FIGS. 9 (*a*) through (*c*) are detailed data processing flowcharts for a step of diagram preparation (ST 6) in FIG. 6, FIG. 11 is the day's diagram, FIG. 12 is a chart of a traffic route of FIG. 11, and FIG. 13 is the updated day's diagram when disorder occurs in train operation. In FIGS. 10 through 13, the ordinate shows a distance and the abscissa shows a time (t). Additionally, S1 through S7 represent stations in the operating route where S1 and S7 represent end stations of the route, S2 through S6 represent intermediate stations on the route, and A0 through A6, B0 through B6, X0 through X6, Y0 through Y6, C2 through C6, D2 through D5 and Z2 through Z7 are control numbers assigned to the train diagram from a starting station to an end station operated by a diagram pattern as shown in FIGS. 11 and 13.

In such case where a train operated according to a diagram of the control number X2 causes a train accident, among the trains operated according to the day's diagram of FIG. 11, between stations S4 and S5 located far from railway yards, and it is impossible for the succeeding trains in operation to avoid the troubled train, a new shuttle diagram for a shuttle service is required from the current on-track positions of trains in train sections between the stations S4, S5 having shuttling installations and both end stations (S1, S7), which sandwich the section where the troubled train is (stations S4 and S5 are referred to as turn-back stations hereinafter). The operation in the case of occurring disorder in the diagram by the train accident or the like will be described with referring to FIGS. 5 through 9.

When judging that a disorder might occur in the diagram due to a train accident or the like, the operator instructs a shuttle diagram preparation and inputs necessary initial data to the shuttle diagram preparation unit 7 through the input device 3 (ST 1). The initial data items (in parentheses) and the contents thereof are as follows: (a) [new preparation/continued preparation] for selecting a new preparation in the first stage or a continued preparation in continuous operation according to the shuttle diagram; (b) [shuttle service start time] for inputting the start time for operation according to the shuttle diagram; (c) [shuttle service time] for setting an operational time according to a shuttle diagram; and (d) [turn-back stations] (two stations) for inputting the station data available for turn-back, for example, which sandwiches the section where the troubled train exists.

Upon receiving the initial data, the shuttle diagram preparing part 75 of the shuttle diagram preparation unit 7 instructs the diagram data I/O 73 to copy the day's diagram stored in the diagram memory 74 to a diagram for preparing a shuttle diagram, that is, a work diagram (ST 2). Then, the diagram data I/O 73 deletes from the work diagram a train diagram that is to be operated during the [shuttle service time] from [shuttle service start time] (ST 3).

When [new preparation] between [new preparation/-continued preparation] being selected for the initial data as shown in FIG. 7, the shuttle diagram preparing part 75 judges the current stopping station or the position between stations of each train from on-track conditions data periodically received from the central processing unit 1 (ST 4.1) and also judged whether any train is present between the two turn-back stations (ST 4.2). Since the trains present between the two turn-back stations are not used during operation according to the shuttle diagram, the shuttle diagram preparing part 75 changes the diagram so as to stop them at the nearest stations within the preparation time, or leaves them as they are if it is impossible to stop them at the nearest stations within the preparation time (ST 4.3). As for the trains in sections outside the section between the two turn-back stations, a state of each train is set from the stopping station or the position between stations (ST 4.4).

On the other hand, when [continued preparation] being selected as shown in FIG. 8, the shuttle diagram preparing part 75 determines the on-track position of each train from the on-track conditions data periodically received, since trains have already been in operation according to the shuttle diagram (ST 5.1), estimates the position of each train in operation at a station or between stations at the end-time of the shuttle diagram (=[shuttle service start time]+[shuttle service time] (ST 5.2), and sets the state of each train (ST 5.3).

Thus, the shuttle diagram preparing part 75 prepares the shuttle diagram through diagram preparation process from the set states (ST 6), rewrites the work diagram stored in the diagram memory 74 with the prepared shuttle diagram via the diagram data I/O 73, and displays the shuttle diagram through the display control means 79 onto the display unit 2 at the operator's instruction ( ST 19 ). The shuttle diagram preparing part 75 instructs the diagram transmitting part 81, in response to the operator's "approval" through the input device 3 (ST 7), to transmit the shuttle diagram by processing type saved in the transmitting diagram controlling part 80 by processing type to the central processing unit 1 (ST 8).

The shuttle diagram preparing part 75 classifies the diagram by processing type and transmits the diagram to the transmitting diagram controlling part 80 by processing type as follows: (a) transmits a diagram deleted in the step ST 3 together with the control number by adding a [delete code] thereto; (b) transmits a diagram together with the control number by adding an [overwrite code] thereto if a certain train is in operation according to the diagram, and it is necessary to change the diagram for preparing the shuttle diagram; (c) and transmits a newly prepared diagram together with the control number by adding an [addition code] thereto.

The diagram receiving part 19 of the central processing unit 1 receives the shuttle diagrams classified by processing type from the shuttle diagram preparing part 75, and transmits them to the diagram changing means 14 (ST 9). The diagram changing means changes the day's diagram saved in the diagram memory 12 by updating according to the shuttle diagram, and saves the updated diagram again in the diagram memory 12 while transmitting the updated diagram to the diagram sectioning means 13 (ST 10). The diagram sectioning means 13 sections the updated diagram to prepare the day's diagram for each station (ST 11), then transmits the day's diagram for each station from the diagram transmitting part 15 through the LAN 4 to the station control device 5 (ST 12).

According to the updated diagram (=shuttle diagram) for each station received by the diagram receiving part 51 (ST 22), the route controlling part 52 of the station control device 5 controls through the interlocking device 6 the train route by controlling the signals and points relative to the train that approaches the controlled station by the control device 5 (ST 23). On the other hand, the updated diagram prepared by the diagram sectioning means 13 is transmitted from the diagram transmitting part 15 to the shuttle diagram preparation unit 7 (ST 13). The diagram receiving part 71 of the shuttle diagram preparation unit 7 receives the updated diagram, and transmits the diagram to the diagram data I/O 73 (ST 14). The diagram data I/O 73 updates the day's diagram stored in the diagram memory 74. The updated diagram is displayed at the operator's instruction onto the display unit 2 through the display control means 79 (ST 20).

On the other hand, the on-track data receiving part 53 of the station control device 5 periodically receives on-track conditions data of the trains operated according to the updated diagram (=shuttle diagram) through the interlocking device 6 (ST 24), and the on-track data transmitting part 54 transmits the on-track conditions data to the central processing unit 1 through the LAN 4 (ST 25). The on-track conditions data received by the on-track data receiving part 16 of the central processing unit 1 (ST 15) is arranged to the on-track conditions data For each train by the on-track data arranging means 17 (ST 16), and the arranged data is transmitted from the on-track data transmitting part 18 to the shuttle diagram preparation unit 7 (ST 17). The on-track data receiving part 72 receives the on-track conditions data (ST 18) and transmits the data to the diagram data I/O 73. The diagram data I/O 73 transmits the data to the shuttle diagram preparing part 75, and updates a diagram of actually operated diagram stored in the diagram memory 74. The operating conditions of the trains are displayed on the display unit 2 according to the actually operated diagram that is updated, in response to the operator's instruction.

The diagram preparation processing (ST 6) in the shuttle diagram preparation unit 7 will be described below in detail with reference to FIGS. 9(*a*) through 9(*c*). The diagrams of the trains in operation which are present outside the section between the [turn-back stations (two stations)] inputted as the initial data, and used for the shuttle service are searched from the work diagram (ST 6.1). If the diagram is searched, the destination of the diagram is changed to the end station or one of the turn-back stations (ST 6.2), and the train type is changed, for example, to a local train for the remaining distance to the destination of the diagram (ST 6.3).

Then, the departure time of the train from the stopping station (or from the station just departed if the train is present between the stations) in operation according to the present diagram is changed to the operation start time of the shuttle diagram (ST 6.4). By repeating steps from ST 6.1 to ST 6.4 until no diagram of trains used for the shuttle service is searched, state setting of the objective trains for the shuttle service is completed (ST 6.5).

After completion of the series of processing, the current position of the objective train for the shuttle service is judged if it is at the end station or at the turn-back station (ST 6.6), and if it is not at either stations, a diagram from the current position to the destination (end station or turn-back station) is prepared for the train. The preparation process is performed by the following steps.

The shuttle diagram preparing part 75 indicates the next station of each train toward the destination from the current position of the train to the simulation means 76 (ST 6.7). The simulation means 76 calculates the train's arrival and departure times at the next station based on the traveling time between stations, the average stoppage time, the approaching intervals to a station, the departing intervals from a station and the like of the train (ST 6.8), and updates the states according to the calculation result, thus, sequentially updating the states of the train to the destination (end station or turn-back station) by repeating the simulation of each station (ST 6.9). The shuttle diagram preparing part 75 prepares a diagram of the simulating station using the calculated time (ST 6.10), and stores it in the work diagram (ST 6.11), while transmitting the diagram of the train as an [overwritten] diagram together with the control number to the transmitting diagram controlling part 80 and saves it therein (ST 6.12). Steps from ST 6.7 to ST 6.12 are repeated until simulation is completed for all the objective trains.

On the other hand, as for the train that completes the preparation of the diagram to the destination and for the train whose current position is at the destination to turn back (end station and turn-back station), a turn-back track number used at the destination to turn back (end station and turn-back station) is determined (ST 6.13). This process is performed by applying technology of an expert system, to determine the turn-back track by searching turn-back tracks currently unoccupied and a turn-back track having a higher priority according to library data of priority order among turn-back tracks of each station and each direction, and according to stored data of operating conditions of trains obtained by the simulations.

In the next place, the control number of the diagram after turn-back of the train with the turn-back track number already determined is newly stored in the work diagram, and destination, train type and the like relative to the diagram are set (ST 6.14). Additionally, a simulating station in relation to the train at the starting station is indicated to the simulating means (ST 6.15), and the arrival and departure times at the simulation station are calculated (ST 6.16). Then, a diagram of the simulating station is prepared by using the calculated times (ST 6.17), and stored in the work diagram (ST 6.18), while transmitted to and saved in the transmitting diagram controlling part 80 together with the control number as an [added] diagram (ST 6.19). The steps from ST 6.14 to ST 6.19 are thus repeated, and the shuttle diagrams are prepared.

When the time of the shuttle diagram draws to the end time of preparation, the head train among the trains running in the same direction and not terminating in simulation is searched (ST 6.20), and a simulating station of the searched train is indicated (ST 6.21). The simulation means 76 estimates the arrival and departure times at each station (ST 6.22), and if the arrival time is before the end time of the shuttle diagram (ST 6.23), a diagram at the simulating station is prepared by the shuttle diagram preparing part 75 using the calculated times (ST 6.24), and stored in the work diagram (ST 6.25), while transmitted to and saved in the transmitting diagram controlling part 80 as an [added] diagram together with the control number (ST 6.26).

If the arrival time is after the end time of the shuttle diagram (ST 6.23), it is checked whether the station is the destination of the simulating train (ST 6.28). If it is the destination, the shuttle diagram preparation is completed (ST 6.29), but if not, simulation is performed to the end station (ST 6.30), and a diagram of each simulating station is prepared by using the calculated times (ST 6.31), then stored in the work diagram (ST 6.32), while transmitted to and saved in the transmitting diagram controlling part 80 as an [added] diagram together with the control number (ST 6.33). The steps from ST 6.21 to ST 6.33 are repeated for other succeeding trains as well, and the shuttle diagram preparation is completed (ST 6.34). Also in the case of shuttle diagram [continued] preparation, the steps from ST 6.21 to ST 6.34 are performed in the same manner.

Embodiment 2

FIG. 10 is a data processing flowchart showing another embodiment of the invention. In this embodiment, an item of [service extension possible/impossible] to other company line and branch line is added to the initial data items to be inputted (ST 100) with the same system structure as Embodiment 1, in the case that a certain station included in the route controlled by the system has the extension line to other company line or to a branch line.

Figure 9A:
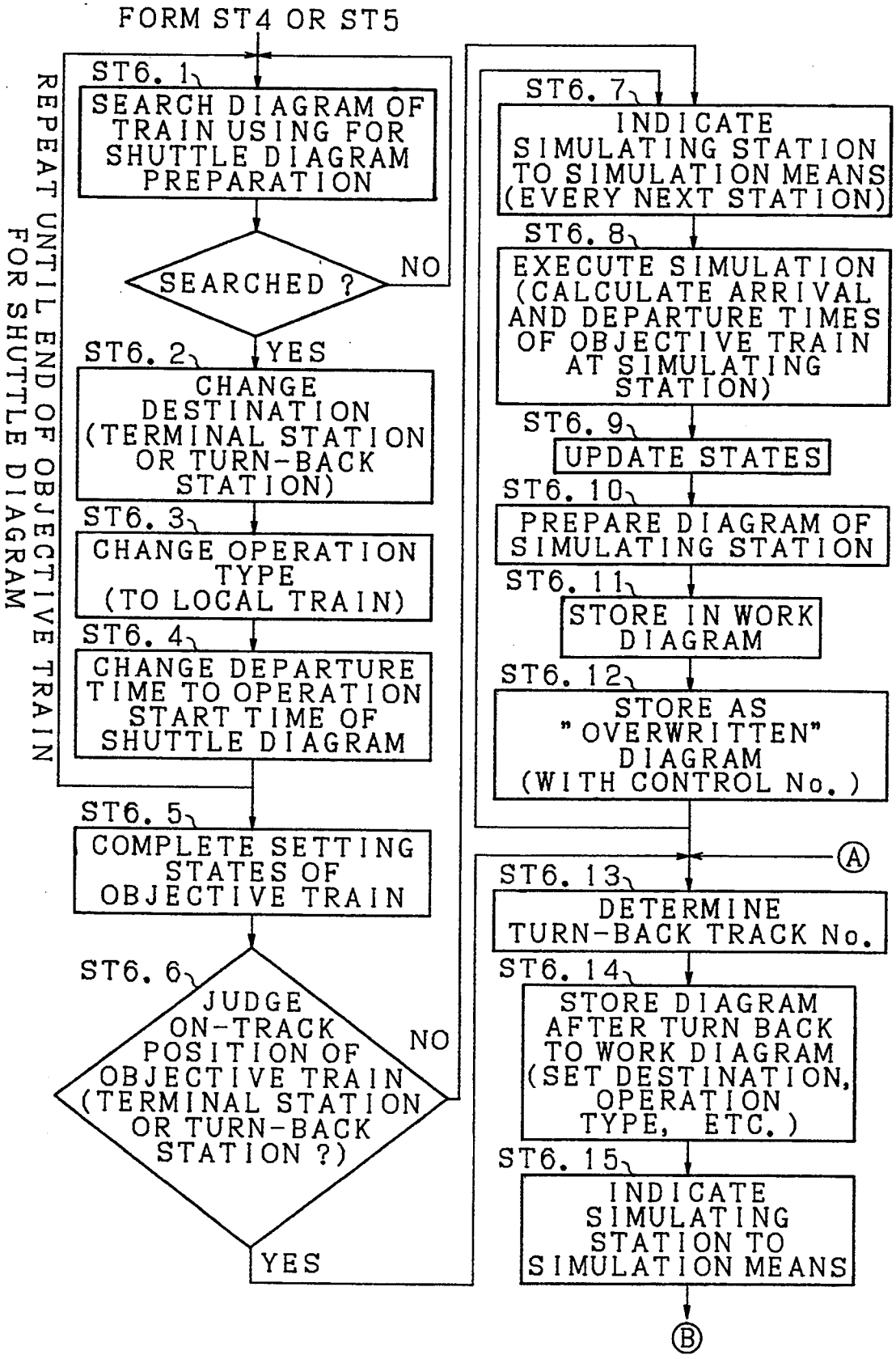
FIG. 9 (*a*) is a detailed data processing flowchart of the step of a diagram preparation (ST 6) in FIG. 6.
Figure 9B:
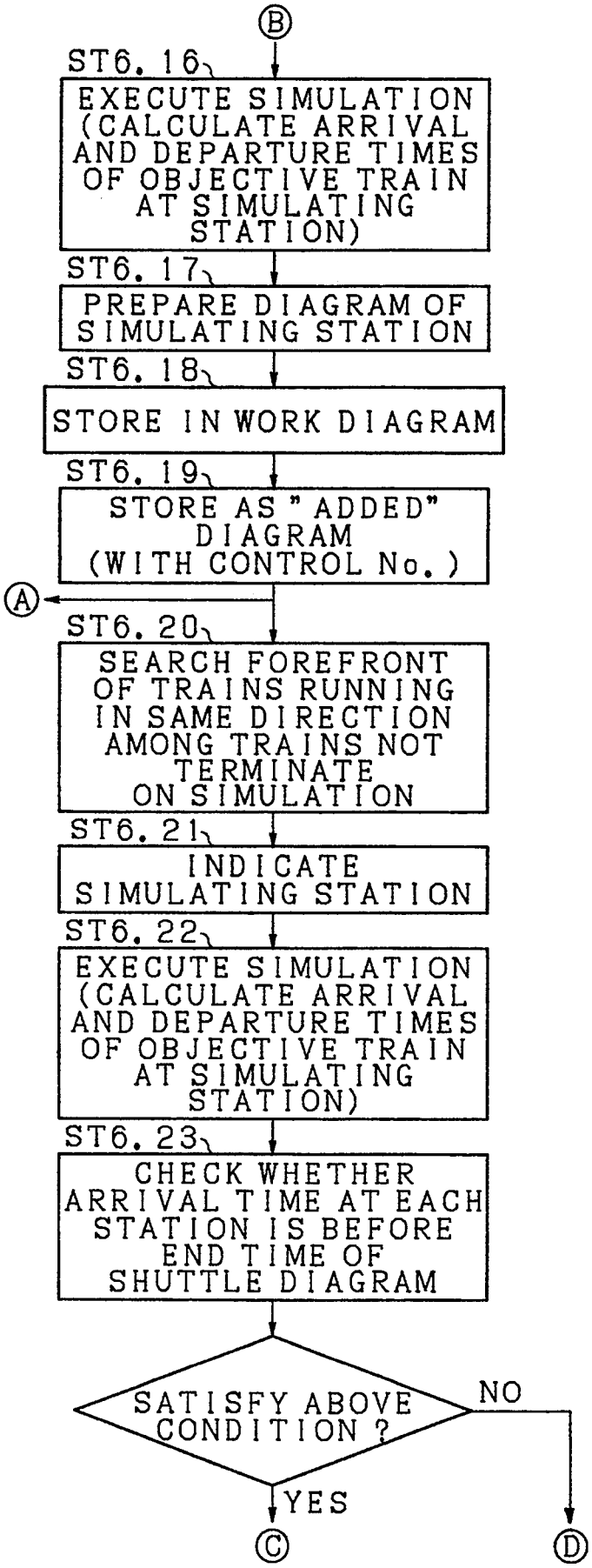
Figure 9C:
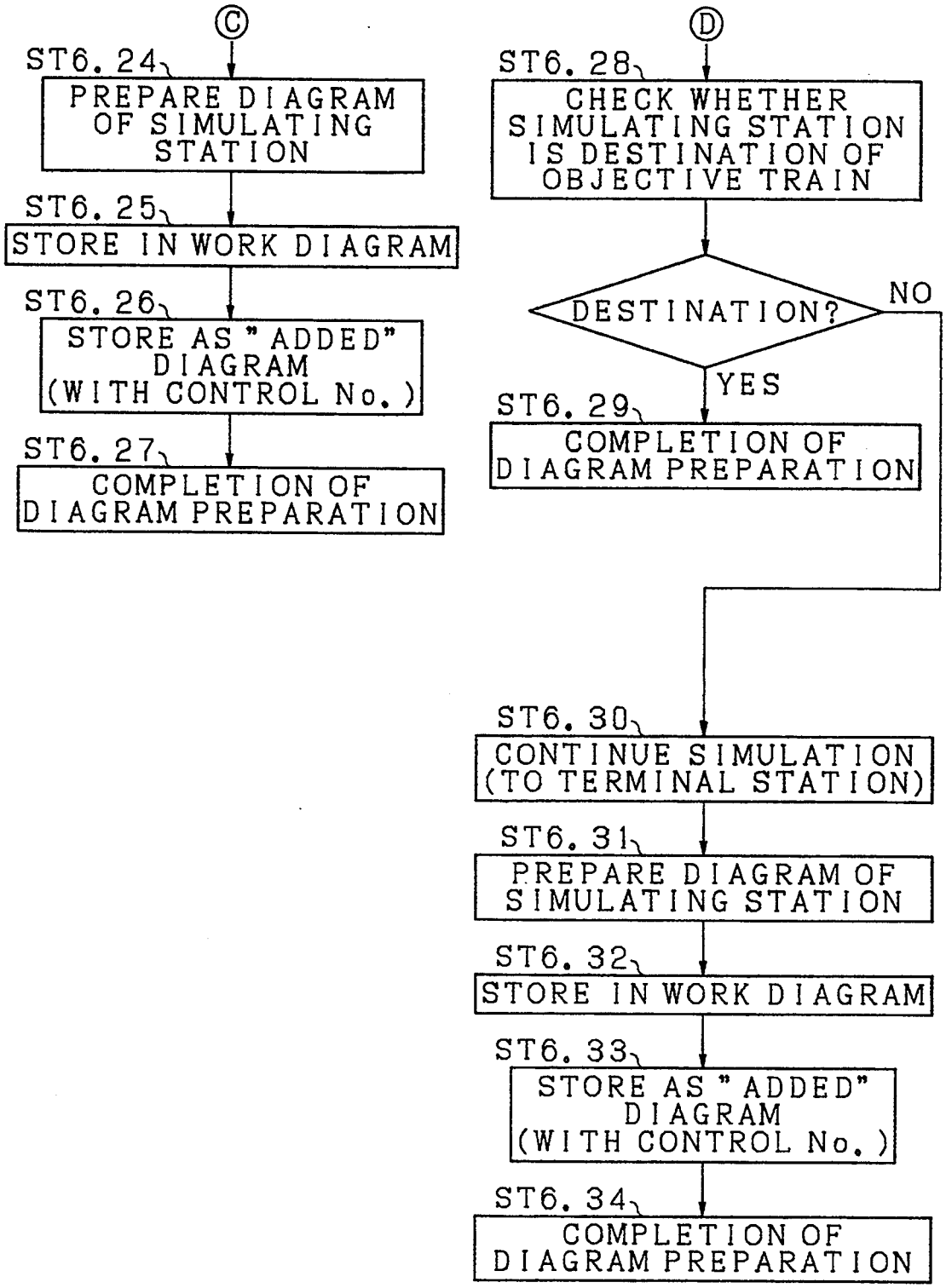

In this embodiment, not only determining the arrival and departure times in. the steps from ST 6.7 to ST 6.10 of FIG. 9 corresponding to Embodiment 1, but if the station has an extension line to other company or to a branch line, and the [service extension] possible is inputted as the initial data (ST 101), a diagram of a switchable train is searched from diagrams of departing trains to the other company line or to a branch line (ST 102). If it is searched (ST 103), so as to determine the next simulating train to be the departing train (ST 104), the work diagram is overwritten (ST 105). Further, after confirming that the shuttle diagram of the current simulating train satisfies the arrival and departure times of the existing diagram of the departing train at stations before the departing station, that is, the stations in the route controlled by the traffic control system (ST 106), a diagram of simulating station is prepared (ST 107). Then, it is stored as an [overwritten] diagram (ST 108).

In addition, if the departing train is entering into the route controlled by the traffic control system again, after confirming that the diagram of the departing train satisfies the arrival and departure times at stations after the approaching station, that is, the stations in the route controlled by the traffic control system (ST 106), a diagram of the simulating station is prepared (ST 107). Then, it is stored as an [overwritten] diagram (ST 107). The arrival and departure times at the station which satisfies those in the controlled route is determined by the steps from ST 6.7 to ST 6.10 shown in FIG. 9.

In the step of "search diagram of switchable train" (ST 102), optimum switching is performed from the following database by applying technology of an expert system. That is to say, by using such data in a database storing "a difference of arrival times between switchable simulating train and departing train to other company or branch line", for example, as "switchable, if a difference of arrival times between simulating train and departing train to other company or branch line is T seconds or less", and such data in a database storing "attribution data of a switchable train" as "trains belongs to A company and those to B company are switchable", an optimum switching is performed.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A train traffic control, comprising:

an input device for inputting current data of trains in operation as initial data of a shuttle service at the time of changing the train operation to the shuttle service;

a file for storing predetermined decision rules including the propriety of approach and departure of the train at each station;

a simulation means for estimating arrival and departure times of the train by a partial simulation in use of the initial data of the shuttle service at each station within a route operated by the shuttle service:

means for deciding arrival and departure times of the train at each station according to the simulation result and to the decision rules;

a diagram preparing means for preparing a shuttle service diagram according to the decision result;

a central processing unit for transmitting the shuttle service diagram to each station; and a station control device for controlling train routes at the station according to the transmitted shuttle service diagram;

wherein said diagram preparing means comprises:

means for judging for each train one of a current stopping station and a position between stations based upon on-track data;

means for determining whether a train is between two turn-back stations which surround a location of service interruption;

means for stopping a first train between said turn-back stations at a station nearest to said first train within a preparation time of said shuttle diagram, and for stopping said first train at its current location if said first train cannot be stopped at said nearest station within said preparation time; and means for setting a state of a second train located outside said two turn-back stations from one of a stopping station or a position between stations other than said turn-back stations.

2. A train traffic control system, comprising:

an input device for inputting current data of trains in operation as initial data of a shuttle service at the time of changing the train operation to the shuttle service;

a file for storing predetermined decision rules including the propriety of approach and departure of the train at each station;

a simulation means for estimating arrival and departure times of the train by a partial simulation in use of the initial data of the shuttle service at each station within a route operated by the shuttle service;

means for deciding arrival and departure times of the train at each station according to the simulation result and to the decision rules;

a diagram preparing means for preparing a shuttle service diagram according to the decision result;

a central processing unit for transmitting the shuttle service diagram to each station; and a station control device for controlling train routes at the station according to the transmitted shuttle service diagram;

wherein said diagram preparing means comprises:

means for searching diagrams of trains in operation outside of two turn-back stations which surround an area of service interruption;

means. for changing destinations of said trains in operation to one of said turn-back stations or an end station; and means for changing a departure time of said trains in operation to an operational start time of said shuttle diagram.

3. train traffic control system according to claim 2, further comprising:

an input means for inputting possibility of the service extension into other line which passes the station included in the shuttle service train section at the time of changing the train operation to the shuttle service; and means for taking a diagram of the service extension in the shuttle service diagram, if the inputted data indicates the service extension possible.

4. An apparatus according to claim 2, wherein said diagram preparing means includes means for indicating a next station of each train to said simulation means; and means for preparing a diagram of a station being simulated using said simulation result.

5. A train traffic control system, comprising:

an input device for inputting current data of trains in operation as initial data of a shuttle service at the time of changing the train operation to the shuttle service;

a file for storing predetermined decision rules including the propriety of approach and departure of the train at each station;

a simulation means for estimating arrival and departure times of the train by a partial simulation in use of the initial data of the shuttle service at each station within a route operated by the shuttle service;

means for deciding arrival and departure times of the train at each station according to the simulation result and to the decision rules;

a diagram preparing means for preparing a shuttle service diagram according to the decision result;

a central processing unit for, transmitting the shuttle service diagram to each station; and a station control device for controlling train routes at the station according to the transmitted shuttle service diagram;

wherein said diagram preparing means comprises:

means for determining a first train among trains running in a same direction, said simulation means simulating arrival times at stations for said first train;

means for preparing a diagram for a station arrived at by said first train if said arrival times are within a period of operation of said shuttle diagram; and means for determining whether a station arrived at by said first train after an end time of said shuttle diagram is a destination of said first train and if not, said simulation means simulates said first train to an end station of said first train.

* * * * *